US006668525B2

(12) United States Patent
Toth et al.

(10) Patent No.: US 6,668,525 B2
(45) Date of Patent: Dec. 30, 2003

(54) CARTON, A BLANK FOR PRODUCING A CARTON, AND METHODS AND APPARATUS FOR ERECTING, CLOSING, AND SEALING A CARTON

(75) Inventors: Zsolt Toth, 132 Bella Vista St., Tuchahoe, NY (US) 10707; Paul A. Chudy, New York, NY (US)

(73) Assignee: Zsolt Toth, Tuchahoe, NY (US)

( * ) Notice: Subject to any disclaimer, the term of this patent is extended or adjusted under 35 U.S.C. 154(b) by 0 days.

(21) Appl. No.: 10/231,270

(22) Filed: Aug. 30, 2002

(65) Prior Publication Data

US 2002/0194822 A1 Dec. 26, 2002

Related U.S. Application Data

(62) Division of application No. 09/799,611, filed on Mar. 7, 2001, now Pat. No. 6,467,682.
(60) Provisional application No. 60/187,407, filed on Mar. 7, 2000.

(51) Int. Cl.[7] ..... B65B 7/20
(52) U.S. Cl. ..... 53/491; 53/415; 53/136.4; 53/377.2; 53/377.6
(58) Field of Search ..... 53/415, 491, 136.4, 53/377.2, 377.6

(56) References Cited

U.S. PATENT DOCUMENTS

| | | | | |
|---|---|---|---|---|
| 327,224 | A | | 9/1885 | Betts |
| 630,789 | A | | 8/1899 | Wyman |
| 671,759 | A | | 4/1901 | Craw |
| 681,322 | A | | 8/1901 | Houghland |
| 915,579 | A | | 3/1909 | Ferres |
| 916,544 | A | | 3/1909 | Ferres |
| 1,468,333 | A | * | 9/1923 | Thom ..... 53/415 |
| 1,587,038 | A | | 6/1926 | Sandor |
| 1,772,106 | A | | 8/1930 | Miller |
| 1,896,721 | A | | 2/1933 | Richards |
| 1,930,348 | A | | 10/1933 | Parrott |
| 2,034,594 | A | | 3/1936 | Norris et al. |
| 2,037,428 | A | | 4/1936 | Newsom |
| 2,070,747 | A | | 2/1937 | Orstrom |
| 2,134,130 | A | | 10/1938 | Hughes |
| 2,178,091 | A | | 10/1939 | Weiss |
| 2,232,088 | A | | 2/1941 | Waters |
| 2,336,763 | A | | 12/1943 | Wilcox |
| 2,357,535 | A | | 9/1944 | Monroe |
| 2,390,909 | A | | 12/1945 | Zinn, Jr. |
| 2,439,735 | A | | 4/1948 | Homrighous |
| 2,521,989 | A | | 9/1950 | McPherson |
| 2,799,442 | A | | 7/1957 | Van Rosen |

(List continued on next page.)

*Primary Examiner*—Rinaldi I. Rada
*Assistant Examiner*—Louis Tran
(74) *Attorney, Agent, or Firm*—Antonelli, Terry, Stout & Kraus, LLP

(57) ABSTRACT

A method of and an apparatus for erecting a carton, and a method of and an apparatus for closing a carton. The carton has 180° fold lines with a compressed area at each end and a slit joining the compressed areas. A carton is erected by moving the blank in a first direction against a stop to form a first set of 90° folds, holding the blank stationary with a suction while pushing the blank in a second direction to form a second set of 90° folds, erecting the carton. A filled carton is closed by advancing it through the central opening of a V-shaped member to increasingly fold the carton top panels. The closed carton is sealed by advancing it through a second V-shaped member and into contact with a pivotally supported sealing device.

4 Claims, 6 Drawing Sheets

U.S. PATENT DOCUMENTS

| | | | | | |
|---|---|---|---|---|---|
| 2,874,891 | A | | 2/1959 | Kelsall | |
| 2,926,777 | A | | 3/1960 | Maguire | |
| 2,999,342 | A | * | 9/1961 | Keely et al. | 53/66 |
| 3,120,335 | A | | 2/1964 | Egleston et al. | |
| 3,163,350 | A | | 12/1964 | Zinn | |
| 3,175,750 | A | | 3/1965 | Bump | |
| 3,197,112 | A | | 7/1965 | Meyer-Jagenberg | |
| 3,232,516 | A | | 2/1966 | Arslanian | |
| 3,236,022 | A | * | 2/1966 | Loveland et al. | 53/75 |
| 3,237,838 | A | | 3/1966 | Elias | |
| 3,244,353 | A | | 4/1966 | Miessler, Sr. | |
| 3,248,039 | A | | 4/1966 | Locke | |
| 3,282,018 | A | * | 11/1966 | Bixley | 53/136.4 |
| 3,466,843 | A | | 9/1969 | Mumper | |
| 3,581,977 | A | | 6/1971 | Kirsky | |
| 3,899,120 | A | | 8/1975 | Fradkin | |
| 4,063,679 | A | | 12/1977 | Henry | |
| 4,428,499 | A | | 1/1984 | Nauheimer | |
| 4,578,054 | A | | 3/1986 | Herrin | |
| 4,586,650 | A | | 5/1986 | Sasaki et al. | |
| 4,667,873 | A | | 5/1987 | Yasui et al. | |
| 4,702,410 | A | | 10/1987 | Derving | |
| 4,732,275 | A | | 3/1988 | Hambleton | |
| 4,785,993 | A | | 11/1988 | Lisiecki | |
| 4,795,085 | A | | 1/1989 | Wein | |
| 4,819,861 | A | | 4/1989 | Nagata | |
| 4,828,539 | A | | 5/1989 | Jonsson et al. | |
| 4,858,822 | A | | 8/1989 | Johnson et al. | |
| 4,909,432 | A | | 3/1990 | Nagata | |
| 4,955,177 | A | * | 9/1990 | Lerner et al. | 53/136.4 |
| 5,056,707 | A | | 10/1991 | Larsen | |
| 5,078,315 | A | | 1/1992 | Floberg | |
| 5,115,625 | A | * | 5/1992 | Barbulesco et al. | 53/467 |
| 5,143,281 | A | | 9/1992 | Mainz et al. | |
| 5,255,842 | A | | 10/1993 | Rosen | |
| 5,322,211 | A | | 6/1994 | Petersen | |
| 5,323,586 | A | * | 6/1994 | Lissoni et al. | 53/136.4 |
| 5,511,362 | A | | 4/1996 | Morita et al. | |
| 5,692,672 | A | | 12/1997 | Hunt | |
| 5,839,254 | A | | 11/1998 | Chen | |
| 5,971,266 | A | | 10/1999 | Sampaolo et al. | |
| 6,067,773 | A | | 5/2000 | Le | |

* cited by examiner

CARTON, A BLANK FOR PRODUCING A CARTON, AND METHODS AND APPARATUS FOR ERECTING, CLOSING, AND SEALING A CARTON

CROSS-REFERENCE TO RELATED APPLICATION

This application is related to U.S. Provisional Patent Application No. 60/187,407 filed Mar. 7, 2000 and is a divisional application of U.S. patent application Ser. No. 09/799,611 filed Mar. 7, 2001 now U.S. Pat. No. 6,467,682.

FIELD OF THE INVENTION

The present invention pertains to a carton, a blank for producing a carton, and methods and apparatuses for erecting, closing and sealing a carton. More particularly, the present invention pertains to a carton which can be rapidly and automatically erected and, after filling, automatically and rapidly closed and sealed. The present invention further pertains to methods and apparatuses for erecting, closing, and sealing cartons of different sizes without adjustment of the apparatuses to accommodate the different sizes. The present invention is particularly suited for, but not limited to, corrugated cartons. Thus, while the following description and drawings make reference to corrugated cartons, the invention is applicable to cartons of other materials.

BACKGROUND OF THE INVENTION

Numerous businesses need to ship large quantities of goods and utilize cartons, particularly corrugated cartons, to hold the goods during shipment. Consequently, such businesses desire to be able to rapidly erect, fill, close, and seal their shipping cartons. FIG. 1 illustrates a typical prior art carton 10 having side surfaces 12 and end surfaces 14. Carton 10 also includes a bottom surface (not shown). Closure panels 16 extend upwardly from side surfaces 12, while closure panels 18 extend upwardly from end surfaces 14. FIG. 2 depicts a carton blank 20 from which a carton 10 might be erected. Carton blank 20 includes the panels 12–18 shown in FIG. 1 and also bottom panels 22 and 24 which correspond, respectively, with the top panels 16 and 18. Preferably, carton blank 20 also includes a sealing strip 26 which extends from one panel, such as the outermost end panel 14 as illustrated in FIG. 2, so that when the carton is erected, strip 26 can be sealed to the adjacent side panel 12, as illustrated in FIG. 1. To enable the necessary folds, panels 16 and 18 must be separated by slots 19, and likewise panels 22 and 24 must be separated by slots 25. Consequently, it is time consuming and expensive to form blank 20.

Erecting carton 10 from blank 20 requires folding panels 22 and 24 inwardly 90°, making 90° folds at the junctions of the panels 12 and 14, sealing the junction of the two bottom panels 22, and sealing the sealing strip 26 to the adjacent panel. The several folds must be performed in sequence, and so require significant time.

Once carton 10 is filled with goods, panels 18 are folded inwardly to overlie those goods, and then panels 16 are folded over panels 18 and the goods to close the carton. The carton then might be sealed, for example by applying a tape along the junction of the two panels 16. FIG. 3 depicts the resulting closed carton 10. The four separate closure panels 16, 18 must be separately folded, with panels 18 folded before panels 16. Consequently, a significant time is required to close carton 10. The junction of the two top panels 16 must then be sealed.

While these various operations might be mechanized, still the large number of steps results in the operations being time consuming. In addition, different sizes of cartons require different equipment sizes in order to perform the operations mechanically. This requires either different apparatuses for different carton sizes, or an apparatus which is adjustable in size, then necessitating the adjustment of the size each time the carton size changes. In addition to being time consuming, these approaches are expensive.

FIG. 9 depicts a carton 162 having side panels 32, 52 and end panels 42, 62 which bridge the side panels. First and second top panels 72, 112 extend upwardly from side panels 32, 52, while first and second fold-in panels 92, 132 extend upwardly from end panels 42, 62 and bridge the top panels. Panels 72, 92, 112 and 132 are joined to their respective side panels and end panels 32, 42, 52, 62 by 90° fold lines 74, 94, 114, and 134. Each fold-in panel 92, 132 has a pair of fold lines 152 which extend from a point substantially at the center of the panel upper edge opposite fold line 94, 134 to the corners of the panel 92, 132 at the ends of fold line 94, 134. Pressure on any panel 72, 92, 112 or 132 can cause the fold-in panels 92, 132 to be folded inwardly on the fold lines 94, 134, forming a 180° fold at each fold line 152 and causing top panels 72, 112 to fold over the top of carton 162, as depicted in FIGS. 10 and 11. Continued such pressure will bring carton 162 to its closed condition, depicted in FIG. 12.

The necessity to make a 180° fold in each fold line 152 has limited the applicability of this type of carton. By way of example, U.S. Pat. No. 2,439,435 shows such a carton used for moisture-proof packaging. However, to permit the 180° folds that are necessary, the carton of this patent is made of paper board. U.S. Pat. No. 5,143,281 shows such a carton made of cardboard having a foil to provide a liquid-tight package. U.S. Pat. No. 5,078,315 likewise shows a liquid containing package having 180° folds. This package is formed of a laminate of paper, thermal plastic, and possibly aluminum foil. U.S. Pat. No. 2,810,506 shows a carton with 180° folds which is made of a sheet material. U.S. Pat. No. 5,056,707 similarly shows a carton made of a sheet material coated with thermoplastics to permit containing of liquids. All of thin material can readily be folded 180°. However, cartons made of such thin materials are unsuitable for heavy duty cartons used for shipping.

U.S. Pat. No. 915,579 shows a shipping container made of a corrugated material and utilizing 180° folds on end flaps. However, the end flaps are first crushed to permit such folding. This, of course, destroys the corrugations and weakens the materials. U.S. Pat. No. 2,926,777 also shows a shipping container made of a corrugated material and having 180° folds. However, to permit such folds in the corrugated material, the fold lines are scored. This severs the corrugation and weakens the material.

SUMMARY OF THE INVENTION

In one aspect, the present invention is a corrugated carton including top panels joined by fold-in panels that fold 180° on fold lines uniquely designed to facilitate that folding. In a second aspect, the present invention is a blank for producing such a corrugated carton. Further aspects of the present invention are methods of and apparatuses for erecting, closing, and sealing a corrugated carton. The carton blank has 180° fold lines that include compressed area at each end and a slit joining the compressed areas. The apparatus for erecting the carton includes a vacuum source for holding the carton stationary as it is erected. The carton closing apparatus includes a V-shaped member that closes the carton top regardless of the carton size. The apparatus for sealing the carton has a second V-shaped member and a sealing arm that is pivotally suspended to bring a sealing wheel into contact with the carton. The carton can be erected, closed, and sealed by hand, if desired, and such manual operations are more readily done with the carton of the present invention than with the prior art carton of FIG. 1. All the panels that close the carton can be folded into place at the same time by simply pressing on any one of the panels.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals: In the drawings:

DETAILED DESCRIPTION

Figure 4:
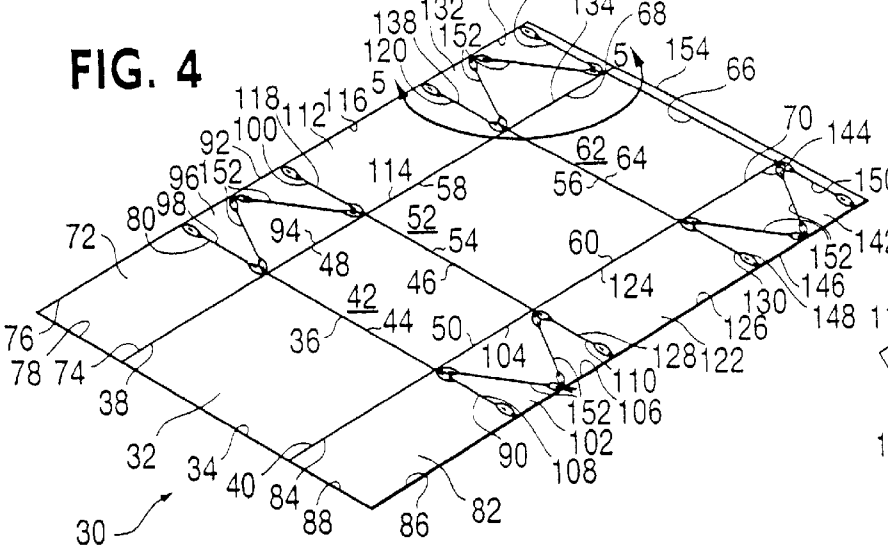
FIG. 4 depicts a first preferred embodiment of a carton blank in accordance with the present invention.

FIG. 4 depicts a preferred embodiment of a carton blank 30 from which a carton in accordance with the present invention can be erected. Blank 30 includes a first side panel 32 having a first end edge 34, a second end edge 36, a top edge 38 and a bottom edge 40. End edges 34 and 36 are substantially parallel with each other, while top edge 38 and bottom edge 40 are substantially parallel with each other and substantially perpendicular to edges 34 and 36. Blank 30 further includes a first end panel 42 having a first side edge 44, a second side edge 46, a top edge 48, and a bottom edge 50. Carton blank 30 also includes a second side panel 52 having a first end edge 54, a second end edge 56, a top edge 58, and a bottom edge 60. Carton 30 further includes a second end panel 62 having a first side edge 64, a second side edge 66, a top edge 68, and a bottom edge 70. Edges 46, 54, 56, 64 and 66 are substantially parallel with edge 34, while edges 48, 58, and 68 are extensions of edge 38, and edges 50, 60, and 70 are extensions of edge 40.

Carton blank 30 also includes a first top panel 72 having a first side edge 74, a second side edge 76, a first end edge 78, and a second end edge 80. Edges 74 and 76 are substantially parallel with edge 38, and edges 78 and 80 are extensions of edges 34 and 36, respectively. Carton blank 30 includes a first bottom panel 82 having a first side edge 84, a second side edge 86, a first end edge 88, and a second end edge 90. Edges 84 and 86 are substantially parallel with edge 38, while edges 88 and 90 are extensions of edges 34 and 36, respectively. Carton blank 30 also includes a first fold-in panel 92 having a first end edge 94, a second end edge 96, a first side edge 98, and a second side edge 100. Edges 94 and 96 are extensions of edges 74 and 76, respectively, while edges 98 and 100 are extensions of edges 44 and 46, respectively. Carton blank 30 has a second fold-in panel 102 having a first end edge 104, a second end edge 106, a first side edge 108, and a second side edge 110. Edges 104 and 106 are extensions of edges 84 and 86 respectively, while edges 108 and 110 are extensions of edges 44 and 46, respectively. Carton blank 30 includes a second top panel 112 having a first side edge 114, a second side edge 116, a first end edge 118, and a second end edge 120. Edges 114 and 116 are extensions of edges 94 and 96, respectively, while edges 118 and 120 are extensions of edges 54 and 56, respectively. Carton blank 30 includes a second bottom panel 122 having a first side edge 124, a second side edge 126, a first end edge 128, and a second end edge 130. Edges 124 and 126 are extensions of edges 104 and 106, respectively, while edges 128 and 130 are extensions of edges 54 and 56, respectively. Carton blank additionally includes a third fold-in panel 132 having a first end edge 134, a second end edge 136, a first side edge 138, and a second side edge 140. Edges 134 and 136 are extensions of edges 114 and 116, respectively, while edges 138 and 140 are extensions of edges 64 and 66, respectively. Carton blank 30 includes a fourth fold-in panel 142 having a first end edge 144, a second end edge 146, a first side edge 148 and a second side edge 150. Edges 144 and 146 are extensions of edges 124 and 126, respectively, while edges 148 and 150 are extensions of edges 64 and 66, respectively.

First end panel 42 extends from first side panel 32, with first side edge 44 of first end panel 42 joined to second side edge 36 of first side panel 32 to define a 90° fold line. Second side panel 52 extends from first end panel 42, with first end edge 54 joined to second side edge 46 to define a 180° fold line. Second end panel 62 extends from second side panel 52, with first side edge 64 joined to second end edge 56 to define a 90° fold line. First top panel 72 extends from first side panel 32, with first side edge 74 joined to top edge 38 to define a 90° fold line. First bottom panel 82 extends from first side panel 32, with first side edge 84 joined to bottom edge 40 to define a 90° fold line. First fold-in panel 92 extends from first end panel 42, with first end edge 94 joined to top edge 48 to define a 90° fold line and with first side edge 98 joined to second end edge 80 to define a 180° fold line. Second fold-in panel 102 extends from first end panel 42, with first end edge 104 joined to bottom edge 50 to define a 90° fold line and with first side edge 108 joined to second end edge 90 to define a 180° fold line. Second top panel 112 extends from second side panel 52, with first side edge 114 joined to top edge 58 to define a 90° fold line and with first end edge 118 joined to second side edge 100 of first fold-in panel 92 to define a 180° fold line. Second bottom panel 122 extends from second side panel 52, with first side edge 124 joined to bottom edge 60 to define a 90° fold line and with first end edge 128 joined to second side edge 110 of second fold-in panel 102 to define a 180° fold line. Third fold-in panel 132 extends from second end panel 62, with first end edge 134 joined to top edge 68 to define a 90° fold line and with first side edge 138 joined to second end edge 120 of top panel 112 to define a 180° fold line. Fourth fold-in panel 142 extends from second end panel 62, with first end edge 144 joined to bottom edge 70 to define a 90° fold line and with first side edge 148 joined to second end edge 130 of bottom panel 122 to define a 180° fold line.

Each fold-in panel 92, 102, 132, and 142 includes a pair of 180° fold lines 152 which extend from a point on the second end edge 96, 106, 136, 146, of the respective panel substantially midway between the first and second side edges of such panel to points at the intersections of the first end edge 94, 104, 134, 144 of the respective panel to points at the intersections of that first end edge and the first and second side edges of such panel.

Figure 15:
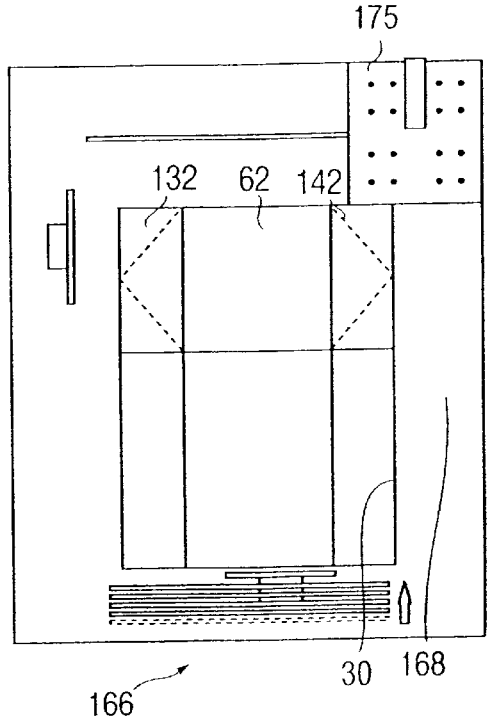

Preferably, carton blank 30 also includes a sealing strip 154, for example extending from third fold-in panel 132, second end panel 62, and fourth fold-in panel 142 as depicted in FIG. 4. Sealing strip 154 includes fold lines which are extensions of the 90° fold lines defined by edges 68 and 134 and edges 70 and 144. After carton blank 30 has been manufactured, it is folded 180° on the fold line defined by edges 46, 54, 100, 110, 118, and 128, and sealing strip 154 is sealed to panels 72, 32, and 82, forming the folded carton blank as depicted in FIG. 15. Alternatively, sealing strip 154 can be omitted, and panels 132, 62, and 142 sealed to panels 72, 32, and 82 by other means such as a sealing tape. Further, instead of making folded carton blank in one piece, it can be made in two pieces which are then sealed together, as discussed below with regard to FIG. 22.

Figure 6:
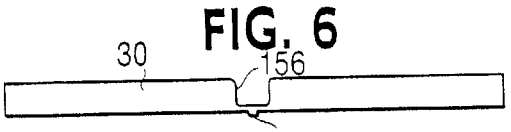
FIG. 6 is a sectional view taken on line 6—6 of FIG. 5.
Figure 7:
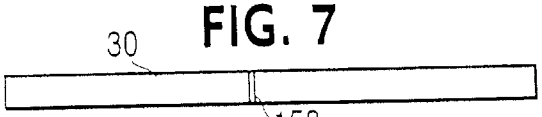
FIG. 7 is a sectional view taken on line 7—7 of FIG. 5.

FIGS. 5–8 show the form of the 180° fold lines. Each 180° fold line includes first and second compressed areas 156 which extend from opposite ends of the 180° fold line for a distance in the order of about two inches and which are joined by a slit 158. Each compressed area 156 is preferably oval in shape with a maximum width in the order of from about ⅜ inch to about ½ inch for standard packing carton corrugated panels. As can be seen in FIG. 6, each compressed area 156 extends into the material of carton blank 30 a substantial distance, while leaving the adjacent panel portions joined. Preferably, a protrusion 160 extends from the undersurface of carton blank 30, substantially along the center line of each compressed area 156 to define a fold line. As can be seen in FIG. 7, each slit 158 extends through carton blank 30.

Figure 8:
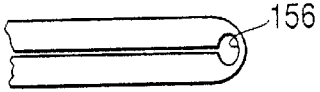
FIG. 8 is a fragmentary view of a 180° fold as made in a carton blank in accordance with the present invention.
Figure 5:
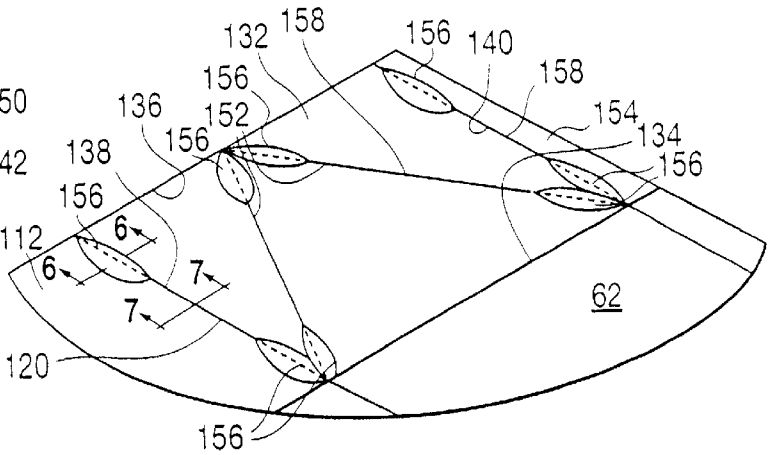
FIG. 5 is an enlarged fragmentary view of area 5—5 of FIG. 4.

FIG. 8 illustrate the manner in which carton blank 30 can be folded 180° as a result of the 180° fold lines formed by compressed areas 156 and slits 158. As can be seen in FIG. 8, as a result of compressed areas 156, the 180° fold is readily made without unduly stressing the carton blank material.

Figure 9:
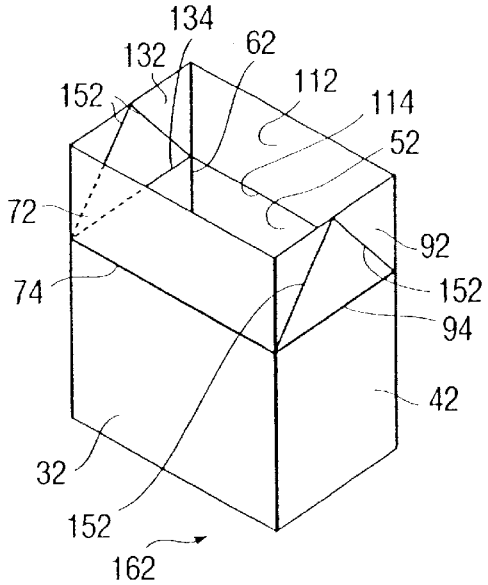
FIGS. 9–13 depict a carton in accordance with the present invention in various degrees of closing.
Figure 10:
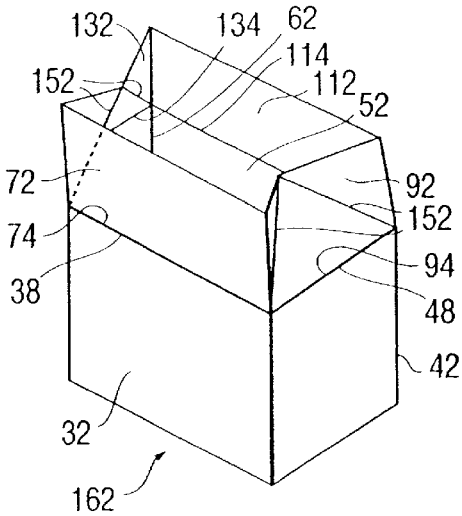
Figure 11:
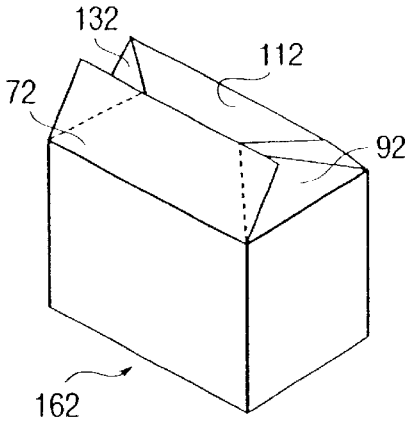
Figure 12:
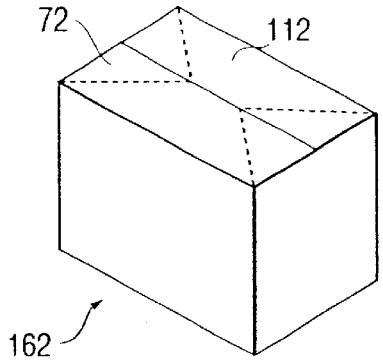
Figure 13:
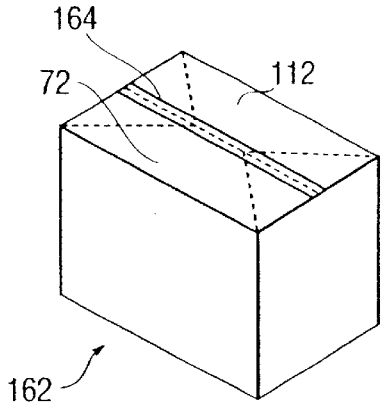

FIGS. 9–13 illustrate the manner in which a carton 162 formed from carton blank 30 can be closed after the carton has been erected and filled. In FIG. 9, carton 162 is illustrated with top panels 72 and 112 and first and second fold-in panels 92 and 132 extending upwardly from their corresponding side panels and end panels. FIG. 10 illustrates carton 162 when fold-in panels 92 and 132 are initially folded in on 180° fold lines 152. Top panels 72 and 112 are folded partially together. FIG. 11 depicts carton 162 with the fold-in panels 152 further folded in and with top panels 72 and 112 folded closer together. FIG. 12 illustrates carton 162 full closed. FIG. 13 shows the closed carton 162 with top panels 72 and 112 sealed together, for example by a sealing tape 164. Carton 162 can be closed and sealed with the method and apparatus of the present invention. Alternatively, if desired, carton 162 can be closed and sealed, as well as erected, manually. Manual erecting and closing of carton 162 can be done rapidly by simply pressing on any one of the bottom panels to erect the carton and any one of the top panels to close the carton. Pressing on any one of the bottom panels or of the top panels causes all of the bottom panels or the top panels to fold inwardly, closing the bottom or the top.

Figure 22:
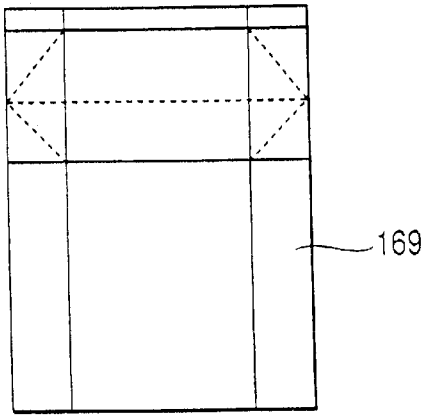
FIG. 22 depicts a second preferred embodiment of a carton blank in accordance with the present invention.
Figure 14:
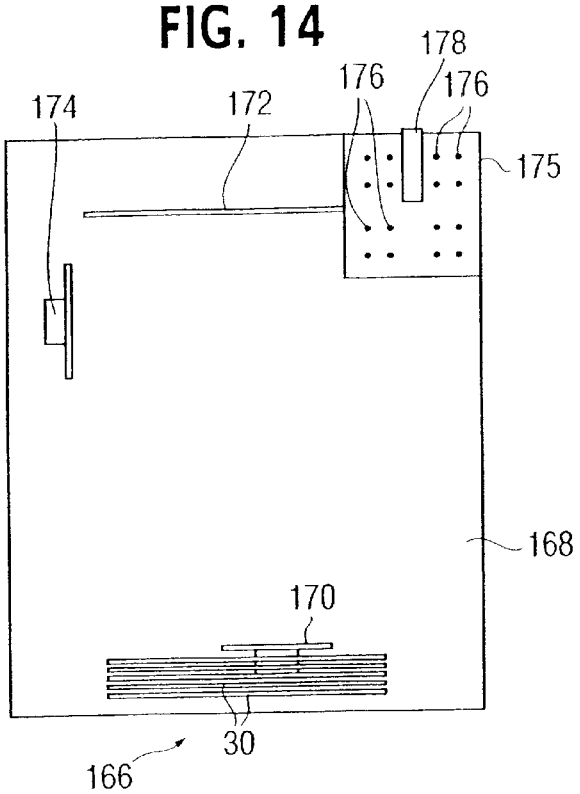
FIGS. 14–21 illustrate preferred embodiments of a method of and an apparatus for erecting a carton in accordance with the present invention.

FIGS. 14–21 illustrate an apparatus 166 for erecting carton 162 from carton blank 30 in accordance with a preferred embodiment the present invention. Apparatus 166 includes an erecting surface 168. A number of carton blanks 30 are provided adjacent one end of erecting surface 168, preferably standing on edge as illustrated in FIG. 14. When a carton 162 is to be erected, one of the carton blanks 30 is released from the stack and falls onto erecting surface 168 as depicted in FIG. 15. Carton blank 30 is then supported on erecting surface 168 with end panel 62 overlying a portion of side panel 32, with third and fourth fold-in panels 132 and 142 overlying portions of first top panel 72 and first bottom panel 82 respectively, and with sealing strip 154 sealed to side panel 32, top panel 72 and bottom panel 82. If desired, rather than the single piece carton blank 30 of FIG. 4, the carton blank could be formed of two blanks 169 as illustrated in FIG. 22. The two blanks 169 are then positioned one over the other, with one rotated 180° with respect to the other, and the sealing strip of each blank is sealed to the other blank. This construction provides a carton blank 30 just as illustrated in FIG. 15.

Figure 16:
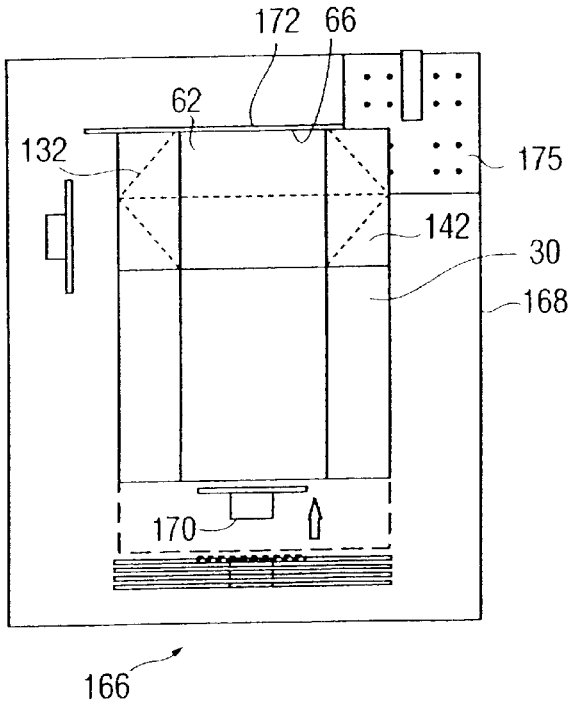
Figure 17:
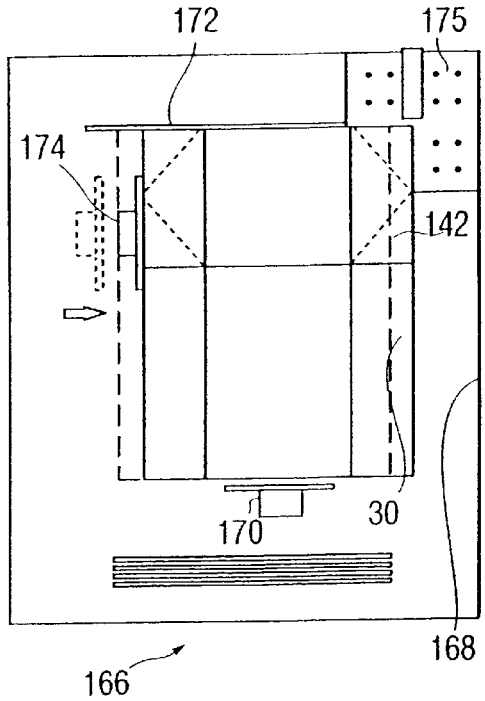
Figure 18:
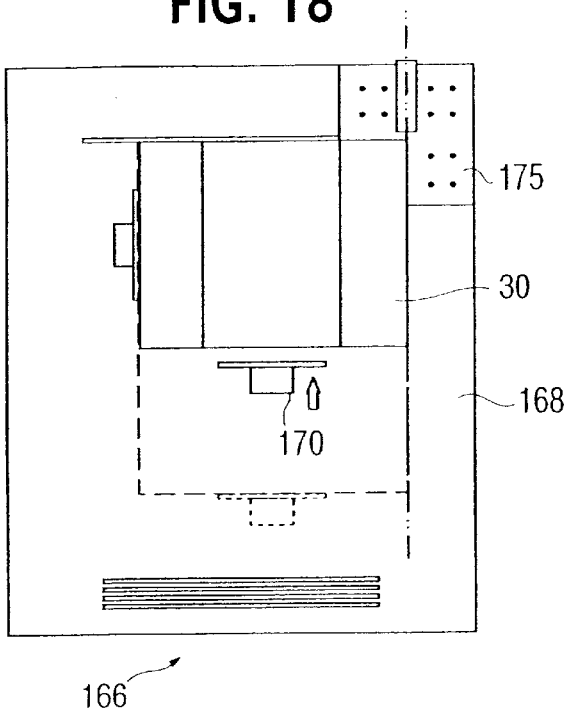
Figure 19:
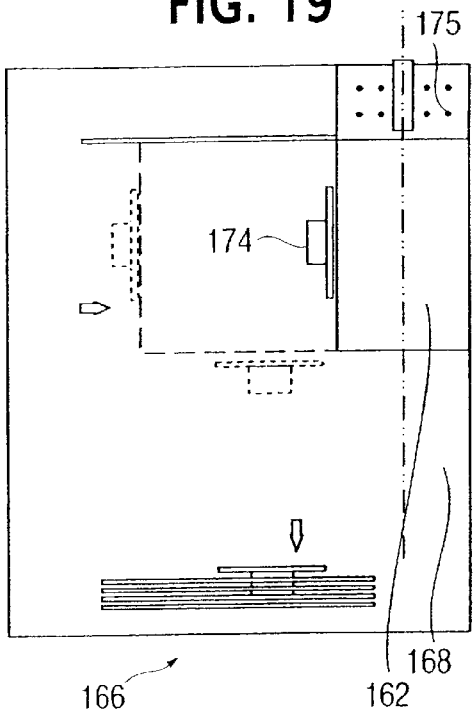
Figure 20:
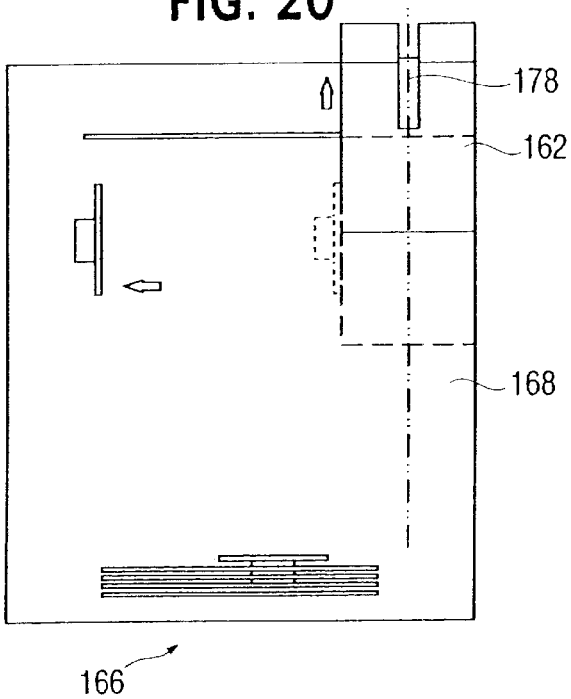
Figure 21:
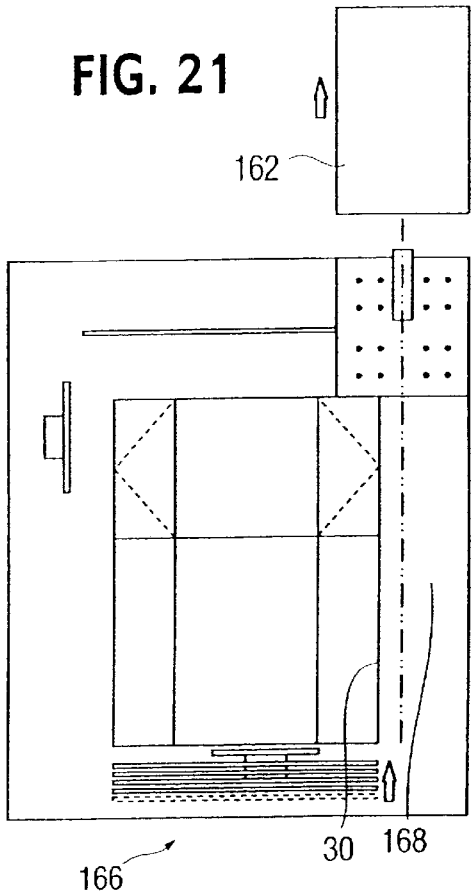

A first actuator 170 is provided adjacent one end of erecting surface 168, and a second actuator 174 is provided adjacent one side of the erecting surface, as depicted in FIG. 14. A vacuum belt 175 having a number of openings 176 defines an erecting position adjacent the corner of erecting surface 168 remote from actuators 170 and 174. Openings 176 are connected to a vacuum source (not shown). As illustrated in FIG. 16, first actuator 170 advances the carton blank 30 until the joined edges 34 and 66 abut against a stop member 172 adjacent the end of erecting surface 168 opposite actuator 170. Second actuator 174 then advances the blank 30 in a direction perpendicular to that of actuator 170 so that one corner of blank 170 overlies the openings 176 at a portion of vacuum belt 175, as depicts in FIG. 17. Suction is then applied through openings 174, firmly holding in place bottom panel 82, which is beneath fourth fold-in panel 142. First actuator 170 advances further, causing the carton blank to fold 90° on the fold lines defined by the respective joined edges 36–42, 80–98, 90–108, 46–54, 100–118, 110–128, 56–64, 120–138, and 130–148, bringing the partially erected carton to the position depicted in FIG. 18. As illustrated in FIG. 19, second actuator 174 then advances the carton blank in its direction of travel while suction is continued through openings 176, causing the carton blank to fold 90° on the fold lines defined by the respective joined edges 38–74, 40–84, 48–94, 50–104, 58–114, 60–124, 68–134, and 70–144. This erects the carton 162 and positions it over several of the openings 176 of vacuum belt 175, as depicted in FIG. 19. FIG. 20 illustrates vacuum belt 175 moving carton 162 over a sealing unit 178, for example a tape sealing unit, which seals bottom panels 82 and 122 together, completing the erection of carton 162. FIG. 21 then depicts the erected carton 162 being conveyed for filling while a second carton blank 30 is released onto erecting surface 168.

Figure 3:
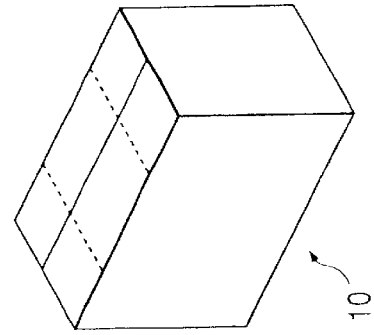
FIG. 3 (PRIOR ART)
FIG. 3 depicts the carton of FIG. 1 closed.
Figure 1:
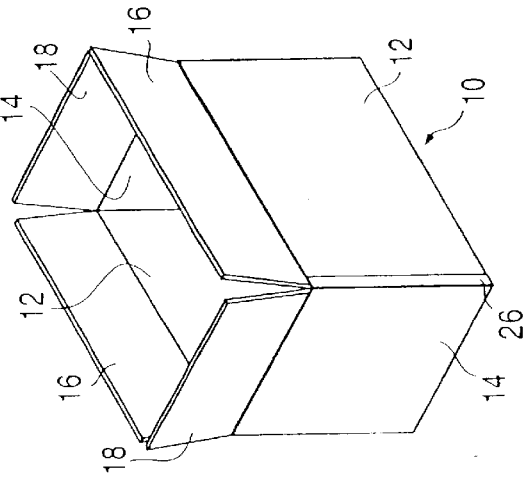
FIG. 1 (PRIOR ART)
FIG. 1 depicts an open prior art carton.
Figure 2:
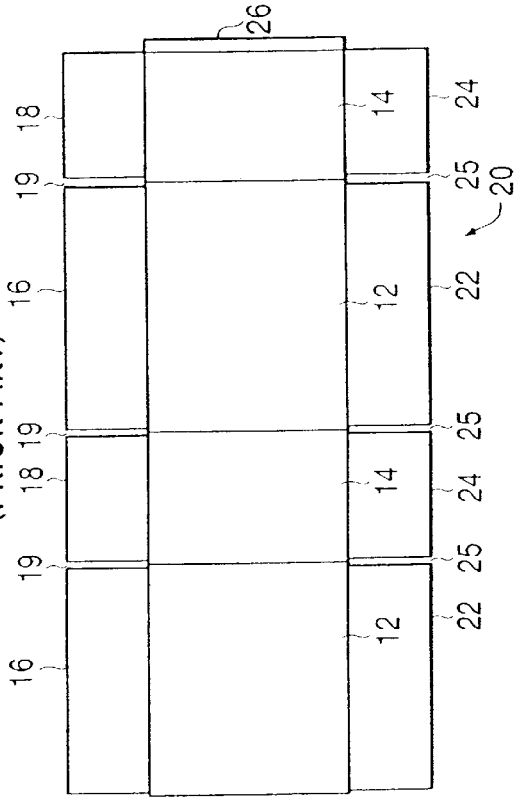
FIG. 2 (PRIOR ART)
FIG. 2 depicts a carton blank from which the carton of FIG. 1 can be erected.
Figure 28:
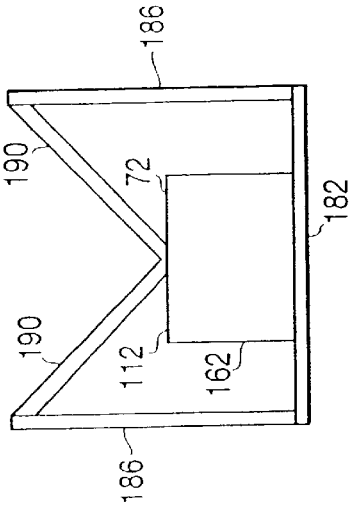
FIGS. 23–28 illustrate preferred embodiments of methods and apparatuses for closing and sealing a carton in accordance with the present invention.
Figure 26:
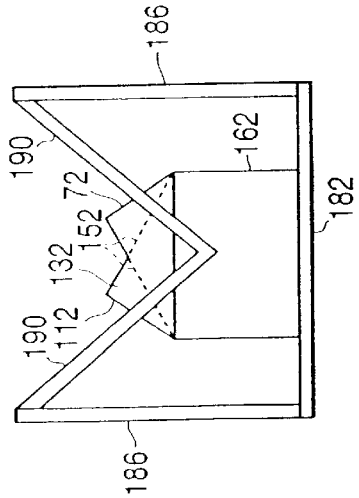
Figure 24:
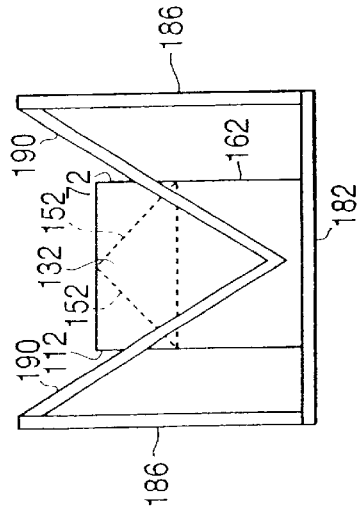
Figure 25:
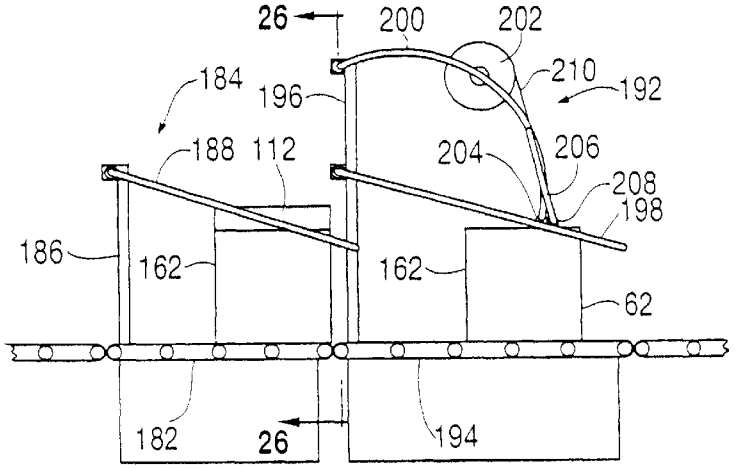
Figure 27:
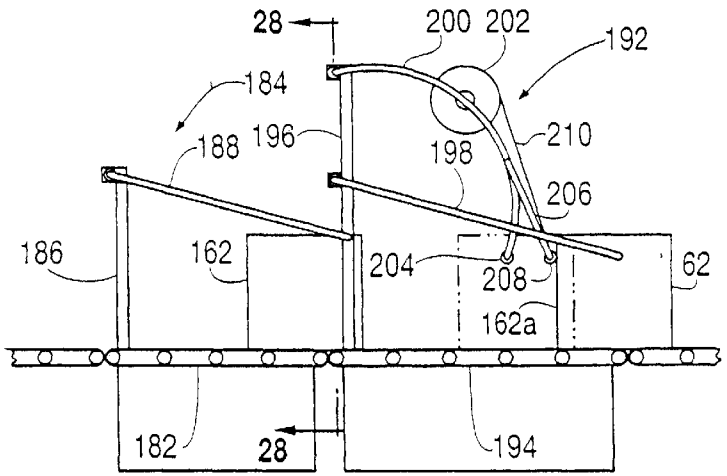

FIGS. 23–28 illustrate the closing of the filled carton 162 in accordance with preferred embodiments of the present invention. Filled cartons are conveyed by a first conveyor 180 to a conveyor 182 of carton closing apparatus 184. A pair of upwardly extending frame member 186 pivotally support a V-shaped centering member 188 above conveyor 182. As seen in FIG. 24, centering member 188 includes a pair of arms 190 which have their upper ends pivotally mounted to the upper ends of frame members 186. The lower ends of arms 190 are connected together at a point above substantially the center of conveyor 182. As the filled container 162 progresses on conveyor 182, it enters the central opening between arms 190 of centering member 188. As container 162 progresses further, arms 190 contact the top panels 72 and 112 of carton 162. The initial contact assures that carton 162 is substantially centered on conveyor 182. Further movement of container 162 on conveyor 182 brings carton 162 into a more narrow portion of the central opening of centering member 188, as depicted in FIG. 25. This causes arms 190 to force top panels 72 and 112 to fold, resulting in fold-in panels 92 and 132 folding progressively inwardly as depicted in FIGS. 10, 11 and 26. Continued movement of carton 162 on conveyor 182 results in full closing of top panel 72 and 112 over the carton as depicted in FIGS. 27 and 28, providing the closed carton of FIG. 12.

The V-shaped form of centering member 188 allows carton closing apparatus 184 to be used with cartons of various sizes. Regardless of the height or width of the carton, its top panels 72 and 112 will contact arms 190 and be closed as the carton progresses on conveyor 182.

Figure 23:
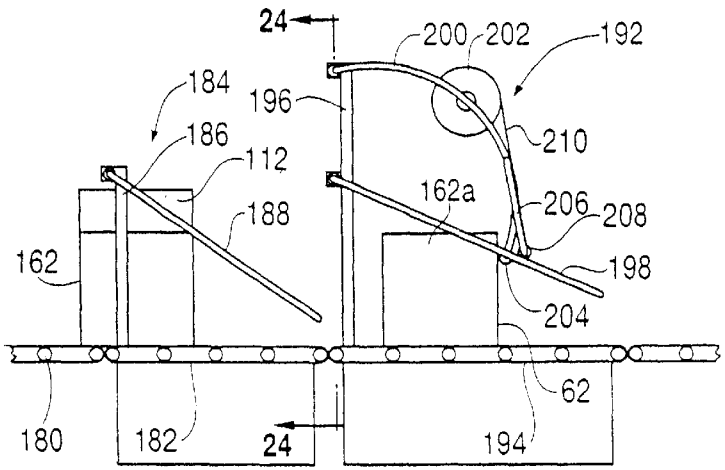

Once the carton 162 is fully closed, as depicted in FIG. 27, the carton can be sealed by sealing apparatus 192. As depicted in FIG. 23, sealing apparatus 192 includes a conveyor 194 to which the closed cartons are transferred from conveyor 182. FIG. 23 depicts a closed carton 162*a* on conveyor 194. Closing apparatus 192 includes a pair of frame members 196 which pivotally support a centering member 198, similar to centering member 188. Again, centering member 198 assures that carton 162*a* is substantially centered on conveyor 194. Support members 196 further pivotally support sealing arm 200 above the central opening of centering member 198. Sealing arm 200 rotatably supports a reel 202 of tape or other suitable sealing material. Sealing arm 200 terminates in a first sealing roller 204 and pivotally supports an arm 206 which supports a second sealing roller 208. Tape 210 from reel 202 wraps around rollers 208 and 204 and onto the leading end panel 62 of carton 162*a,* as depicted in FIG. 23. As carton 162*a* progresses on conveyor 194, sealing arm 200 pivots upwardly, bringing sealing rollers 204 and 208 onto the top surface of the closed carton 162. This applies tape along the junction of top panels 72 and 112 of carton 162*a,* as illustrated in FIG. 25. Further movement of carton 162*a* on conveyor 194 results in rollers 204 and 208 progressing down the second end panel 42 of carton 162*a,* as depicted in FIG. 27. The sealing mechanism can include a blade or other suitable means which is actuated by movement of the arm 206 to the position of FIG. 27 to cut the tape once carton 162*a* is fully sealed.

Figure 29:
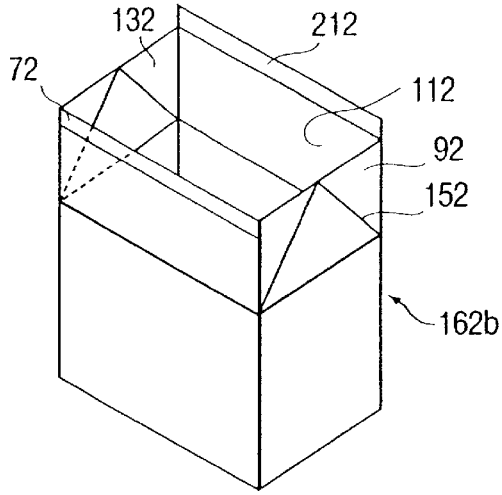
FIG. 29 depicts an alternative embodiment of a carton in accordance with the present invention.

FIG. 29 depicts an alternative embodiment of carton 162*b* having a strip 212 of sealing tape afixed to top panel 112 so that when top panels 72 and 112 are closed, the strip will adhere to panel 72, sealing the carton. With this embodiment, sealing apparatus 192 is not necessary.

The present invention is thus seen to provide an improved carton blank that can be readily erected closed, and sealed, and improved methods of and apparatuses for erecting, closing, and scaling cartons. Although the invention has been described with reference to preferred embodiments, rearrangements, alterations, and substitutions can be made, and still the result will be within the scope of the invention.

What is claimed is:

1. A method of closing and sealing a carton having a bottom surface, first and second side surfaces extending upwardly from first and second sides of the bottom surface respectively, first and second end surfaces extending upwardly from first and second ends of the bottom surface respectively and bridging opposite ends of the first and second side surfaces, first and second top panels extending upwardly from the first and second side surfaces respectively, and first and second fold-in panels extending upwardly from the first and second end surfaces respectively and bridging opposite ends of the first and second top panels, said method comprising:

providing a movement path beneath a central opening formed between the arms of a substantially V shaped centering member having two arms, each arm having a first end and a second end, the arm first ends being spaced apart to form the wide end of the V shape, with sufficient width to permit the carton to enter the central opening, and the arm second ends being connected together to form the point of the V shape, the centering member wide end being pivotally mounted above the movement path, and the centering member point hanging down toward the movement path, with the movement path extending beneath a central opening formed between the arms of a second substantially V shaped member having two arms, each arm of the second V shared member having a first end and a second end, the arm first ends of the second V shaped member being spaced apart to form the wide end of the V shape, and the arm second ends of the second V shaped member being connected together to form the point of the V shape, the second V shaped member wide end being pivotally mounted above the extended movement path, and the second V shaped member point hanging down toward the extended movement path, the second V shaped member further having a sealing arm with a first end pivotally mounted above the central opening of the second V shaped member and a second end hanging down through the central opening of the second V shaped member toward the movement path and having a seal dispenser thereon;

advancing the carton along the movement path and into the central opening of the centering member from the wide end toward the narrow end, with the carton first and second top panels and first and second fold-in panels extending upwardly from the first and second side surfaces and first and second end surfaces, respectively, to cause the arms to contact the carton and center the carton on the movement path;

continuing to advance the carton along the movement path and into a more narrow portion of the central opening of the centering member to cause the arms to fold all the top panels over the carton simultaneously, with the carton fold-in panels folding inwardly beneath the top panels, thereby closing the top of the carton; and continuing to advance the closed carton along the extended movement path and beneath the central opening of the second V shaped member to cause the seal dispenser to contact the closed top of the carton as the carton moves on the movement oath and dispense a sealing material onto adjacent edges of the top panels, sealing the first and second top panels together to seal the closed carton.

2. Apparatus for closing and sealing a carton having a bottom surface, first and second side surfaces extending upwardly from first and second sides of the bottom surface respectively, first and second end surfaces extending upwardly from first and second ends of the bottom surface respectively and bridging opposite ends of the first and second side surfaces, first and second top panels extending upwardly from the first and second side surfaces respectively, and first and second fold-in panels extending upwardly from the first and second end surfaces respectively and bridging opposite ends of the first and second top panels, said apparatus comprising:

means defining a movement path;

a substantially V shaped centering member having two arms, with a central opening between the arms, each arm having a first end and a second end, the arm first ends being spaced apart to form the wide end of the V shape, with sufficient width to permit the carton to enter the central opening, and the arm second ends being connected together to form the point of the V shape;

means pivotally mounting the centering member wide end above the movement path with the centering member point hanging down toward the movement path, to permit the carton to enter the central opening of the centering member so that the arms contact the carton to center the carton on the movement path and fold all the top panels over the carton simultaneously, with the carton fold-in panels folding inwardly beneath the top panels, thereby closing the top of the carton;

a second substantially V shaped member having two arms, with a central opening between the arms, each arm of the second V shaped member having a first end and a second end, the arm first ends of the second V shaped member being spaced apart to form the wide end of the V shape, and the arm second ends of the second V shaped member being connected together to form the point of the V shape;

means pivotally mounting the second V shaped member wide end above the movement path with the second V shaped member point hanging down toward the movement path;

a sealing arm;

means pivotally mounting the first end of the sealing arm above the central opening of the second V shaped member with the second end of the sealing member hanging down through the central opening of the second V shared member toward the movement path; and a seal dispenser mounted on the second end of the sealing arm to contact the closed top of the carton as the carton moves on the movement path and dispense a sealing material onto adjacent edges of the top panels, sealing the first and second top panels together to seal the closed carton.

3. A method of sealing a closed carton having a bottom surface, first and second side surfaces extending upwardly from first and second sides of the bottom surface respectively, first and second end surfaces extending upwardly from first and second ends of the bottom surface respectively and bridging opposite ends of the side surfaces, and first and second top panels extending over the carton from the first and second side surfaces respectively to close the top of the carton, said method comprising:

providing a movement path beneath a central opening formed between the arms of a substantially V shaped member having two arms, each arm of the V shaped member having a first end and a second end, the arm first ends of the V shaped member being spaced apart to form the wide end of the V shape, and the arm second ends of the V shaped member being connected together to form the point of the V shape, the V shaped member wide end being pivotally mounted above the movement path, and the V shaped member point hanging down toward the movement path, the V shaped member further having a sealing arm with a first end pivotally mounted above the central opening of the V shaped member and a second end hanging down through the central opening of the V shaped member toward the movement path and having a seal dispenser thereon, said method comprising:

advancing the closed carton along the movement path and beneath the central opening of the V shaped member to cause the seal dispenser to contact the closed top of the carton as the carton moves on the movement path and dispense a sealing material onto adjacent edges of the top panels, sealing the first and second top panels together to seal the closed carton.

4. Apparatus for sealing a closed carton having a bottom surface, first and second side surfaces extending upwardly from first and second sides of the bottom surface respectively, first and second end surfaces extending upwardly from first and second ends of the bottom surface respectively and bridging opposite ends of the first and second side surfaces, and first and second top panels extending over the carton from the first and second side surfaces respectively to close the top of the carton, said apparatus, comprising:

means defining a movement path;

a substantially V shaped member having two arms, with a central opening between the arms, each arm of the V shaped member having a first end and a second end, the arm first ends being spaced apart to form the wide end of the V shape, and the arm second ends being connected together to form the point of the V shape;

means pivotally mounting the V shaped member wide end above the movement path with the V shaped member point hanging down toward the movement path;

a sealing arm;

means pivotally mounting the first end of the sealing arm above the central opening of the V shaped member with the second end of the sealing member hanging down through the central opening of the V shaped member toward the movement path; and a seal dispenser mounted on the second end of the sealing arm to contact the closed top of the carton as the carton moves on the movement path and dispense a sealing material onto adjacent edges of the top panels, sealing the first and second top panels together to seal the closed carton.

* * * * *